US012258156B2

(12) United States Patent
Fukuda et al.

(10) Patent No.: US 12,258,156 B2
(45) Date of Patent: Mar. 25, 2025

(54) BUNDLING TOOL DEVICE

(71) Applicant: HELLERMANNTYTON GmbH, Tornesch (DE)

(72) Inventors: Taro David Fukuda, Hamburg (DE); Andreas Schwinn, Hamburg (DE)

(73) Assignee: HELLERMANNTYTON GmbH, Tornesch (DE)

( * ) Notice: Subject to any disclaimer, the term of this patent is extended or adjusted under 35 U.S.C. 154(b) by 145 days.

(21) Appl. No.: 18/048,189

(22) Filed: Oct. 20, 2022

(65) Prior Publication Data

US 2023/0126004 A1 Apr. 27, 2023

(30) Foreign Application Priority Data

Oct. 21, 2021 (DE) ..... 20 2021 105 773.4
Mar. 9, 2022 (DE) ..... 20 2022 101 283.0

(51) Int. Cl.
*B65B 13/06* (2006.01)
*B65B 13/22* (2006.01)
*B65B 13/24* (2006.01)

(52) U.S. Cl.
CPC ..... *B65B 13/06* (2013.01); *B65B 13/22* (2013.01); *B65B 13/24* (2013.01)

(58) Field of Classification Search
CPC ..... B65B 13/027; B65B 13/06; B65B 13/22; B65B 13/24
See application file for complete search history.

(56) References Cited

U.S. PATENT DOCUMENTS

| | | | |
|---|---|---|---|
| 3,258,819 | A | 7/1966 | Weckesser |
| 3,537,146 | A | 11/1970 | Caveney |
| 3,900,922 | A | 8/1975 | McCormick |
| 4,236,280 | A | 12/1980 | Kreiseder |
| 4,269,379 | A | 5/1981 | Mccormick |
| 4,371,011 | A | 2/1983 | Hidassy |

(Continued)

FOREIGN PATENT DOCUMENTS

| | | |
|---|---|---|
| CN | 110127101 | 8/2019 |
| CN | 110127102 | 8/2019 |

(Continued)

OTHER PUBLICATIONS

"Extended European Search Report", EP Application No. 23179733.3, Nov. 13, 2023, 7 pages.

(Continued)

*Primary Examiner* — Anna K Kinsaul
*Assistant Examiner* — Himchan Song
(74) *Attorney, Agent, or Firm* — Colby Nipper PLLC

(57) ABSTRACT

The disclosure relates to an automatic bundling tool device (ABT) for bundling a bundling good by means of a one-piece-tie (OPT). In an aspect, an ABT includes: a holding unit configured to receive, hold, and release a respective OPT which is provided to the ABT from an external reservoir of OPTs; a linear motion guiding unit configured to linearly guide the holding unit in a longitudinal direction while moving between a receiving position where the holding unit receives, during intended use, the respective OPT and a releasing position where the holding unit releases, during intended use, the respective OPT; and a drive unit configured to move the holding unit along the linear motion guiding unit.

20 Claims, 6 Drawing Sheets

(56) References Cited

U.S. PATENT DOCUMENTS

| | | | | |
|---|---|---|---|---|
| 4,557,023 | A | 12/1985 | Six et al. | |
| 4,735,387 | A | 4/1988 | Hirano et al. | |
| 4,805,856 | A | 2/1989 | Nicoli et al. | |
| 5,205,328 | A * | 4/1993 | Johnson | B65B 13/027 140/93.2 |
| 5,386,615 | A | 2/1995 | Bernard | |
| 5,759,004 | A | 6/1998 | Kuffel | |
| 5,826,308 | A | 10/1998 | Chang | |
| 6,070,304 | A | 6/2000 | Lii | |
| 6,119,314 | A | 9/2000 | Freed | |
| 6,244,899 | B1 | 6/2001 | Bogursky et al. | |
| 6,279,620 | B1 * | 8/2001 | Eason | B65B 13/027 140/93.2 |
| 6,347,435 | B1 | 2/2002 | Davignon et al. | |
| 6,530,126 | B2 | 3/2003 | Caveney | |
| 6,533,226 | B2 | 3/2003 | Geiger | |
| 6,640,839 | B2 | 11/2003 | Thieme | |
| 6,807,714 | B2 | 10/2004 | O'young et al. | |
| 7,278,188 | B2 | 10/2007 | Kurmis | |
| 7,661,633 | B2 | 2/2010 | Igarashi et al. | |
| 8,281,461 | B2 | 10/2012 | Geiger | |
| 10,479,574 | B2 | 11/2019 | Vorhis | |
| 2002/0084388 | A1 | 7/2002 | Geiger | |
| 2007/0023586 | A1 | 2/2007 | Geiger | |
| 2007/0234524 | A1 | 10/2007 | Witt | |
| 2008/0250609 | A1 | 10/2008 | Franks | |
| 2010/0306967 | A1 * | 12/2010 | Geiger | F16L 3/2334 24/16 PB |
| 2016/0280405 | A1 * | 9/2016 | Thieme | B65B 13/027 |
| 2019/0106231 | A1 * | 4/2019 | Schwinn | B65B 13/027 |
| 2019/0144149 | A1 * | 5/2019 | Dohrmann | B65B 13/027 140/93.2 |
| 2019/0248521 | A1 * | 8/2019 | Hillegonds | B65B 27/06 |
| 2020/0156224 | A1 * | 5/2020 | Suenaga | B25B 25/00 |
| 2020/0391891 | A1 * | 12/2020 | Xu | B65B 13/16 |
| 2023/0126004 | A1 * | 4/2023 | Fukuda | B65B 13/06 53/589 |
| 2023/0131919 | A1 | 4/2023 | Fukuda et al. | |
| 2023/0349491 | A1 | 11/2023 | Fish | |

FOREIGN PATENT DOCUMENTS

| | | |
|---|---|---|
| CN | 209921662 | 1/2020 |
| CN | 111071527 | 4/2020 |
| DE | 3382610 | 4/1993 |
| DE | 69313329 | 3/1998 |
| DE | 202004018890 | 2/2005 |
| EP | 3712076 | 9/2020 |
| EP | 3747781 | 12/2020 |
| FR | 2429921 | 1/1980 |
| KR | 200431100 | 11/2006 |
| WO | 2005099402 | 10/2005 |
| WO | 2019051624 | 3/2019 |
| WO | 2019149253 A1 | 8/2019 |

OTHER PUBLICATIONS

"Final Office Action", U.S. Appl. No. 12/478,863, filed Apr. 11, 2012, 10 pages.
"Non-Final Office Action", U.S. Appl. No. 12/478,863, filed Jul. 18, 2021, 9 pages.
"Notice of Allowance", U.S. Appl. No. 12/478,863, filed Aug. 20, 2012, 8 pages.
"Restriction Requirement", U.S. Appl. No. 12/478,863, filed May 17, 2021, 7 pages.
"Search Report", DE Application No. 20-2022-100676.8, Sep. 27, 2022, 3 pages.
"Extended European Search Report", EP Application No. 22202483.8, Apr. 25, 2023, 7 pages.
"Undated Button Head Tie Product", Apr. 24, 2013, 3 pages.
"Non-Final Office Action", U.S. Appl. No. 18/330,836, filed Aug. 20, 2024, 8 pages.
"Non-Final Office Action", U.S. Appl. No. 18/048,375, filed Dec. 27, 2024, 16 pages.
"Notice of Allowance", U.S. Appl. No. 18/330,836, filed Nov. 20, 2024, 6 pages.

* cited by examiner

BUNDLING TOOL DEVICE

INCORPORATION BY REFERENCE

This application claims priority to German Utility Model Number 202022101283.0, filed Mar. 9, 2022, and German Utility Model 202021105773.4, filed Oct. 21, 2021, the disclosures of which are incorporated by reference in their entireties.

BACKGROUND

In an automatic bundling tool device, usually a cable tie, or, more generally, a one-piece-tie, is being moved in a set of guide elements of a guide unit until a loop is created by the one-piece-tie around the bundling good. The tip of the one-piece-tie is arranged, in the longitudinal direction, in front of the one-piece-tie head part and is then pushed along the guide elements through an opening, a window, in the head part by decreasing the loop diameter by respective guide claws as guide elements. Then, a tensioning or tightening system grips a strap part of the one-piece-tie and tensions or tightens the one-piece-tie around a bundle of cables or the like.

Currently, different strategies for transporting cable ties or one-piece-ties in automatic bundling tool devices are employed. One approach relies on pneumatics. There, a cable tie is shot through e.g. a feeding hose and/or a channel via pressurized air, comparable to a blow gun. Those cable ties are generally provisioned as loose cable ties and supplied from for instance a vibrational feeder device. Currently this principle is only possible for standard cable ties without an attached foot part, that is, it is not possible for one-piece-ties in general. This approach is realized in EP 19 747 727 A1, for example.

Another approach relies on mechanics. One possibility is to pre-attach multiple cable ties to a bandoleer which is then fed to the automatic bundling tool device, ABT. The transport in the ABT is then achieved by a mechanical pusher mechanism acting on the respective single cable tie cut loose from the bandoleer. This is feasible for standard cable ties and selected one-piece fixing ties.

There, cable ties are pre-attached to an external bandoleer which is fed into the tool device by a longitudinally grooved drum rotating about its longitudinal axis. The ties are orientated with their respective tips facing in the forward direction and their head parts facing in backward direction. One after another, each tie is being transported in direction of rotation. Then, each tie is being separated from the bandoleer by blades. After rotating by a certain angle, a single tie is located in the lower end of the drum and then sits on a horizontal plane.

Then, in said horizontal plane, the tie is linearly pushed forward in the longitudinal direction with regard to the drum. Pushing is achieved by a tie advancer drive consisting of a flexible pusher similar to a cable tie but of greater rigidity so as not to buckle easily under load. The flexible pusher is serrated with a gearing and actuated by a motor-driven pinion. So, this mechanism corresponds to a rack-and-pinion mechanism with a flexible rack. During motion, the pusher is guided through a channel and contacts the back end of the tie's head part, moving it forward. The transport process is rigidly linked to the tool's application cycle by means of a crank drive which connects the tie advancer drive to an electric motor. The transport process is precisely adjusted to a certain timing and certain travel of the pusher and is therefore limited to a single cable tie type, in particular to ties with one single given strap length.

Due to the low buckling resistance of thin elongate parts made from plastics, it is necessary to ensure linear motion of both tie and flexible pusher by suppressing breakouts in any direction. Therefore, the lower and side faces of the drum grooves, as well as additional guiding rails comprise a tie channel guiding the tie and pusher without diverging. When the pusher is advanced to the maximally forward position, the cable tie is fully looped around the bundling good and tensioning begins. As soon as tensioning begins, the pusher starts to move in the backward direction, losing contact with the tie head part and eventually reaching its initial position being ready for the next cycle.

An alternative possibility is to use a mechanical slider which is incorporating a holding fixture that holds the one-piece fixing tie, OPT, by its head. The slider can be driven in a longitudinal direction to move the one-piece tie forward towards the bundling good and is usually designed for holding one specific given type of OPT. The approach of EP 18 903 233 A1 shows such a solution.

So, the known pneumatic and mechanical principles for transporting ties in automatic bundling tool devices are generally limited to one single predetermined type of tie with regard to cable tie geometry, head part shape, neck part shape, foot part shape, strap length, strap thickness, strap broadness, for each type of automatic bundling tool device available in the market. This is due to the fact that the tool device design is optimized for a certain type of OPT in terms of available space in a housing of the tool device, drive dimensioning, mechanism timings, clearance between moving parts etc. in order to reduce complexity and minimize process tolerances while maximizing reliability during the automated application of the tool device. As a result, both length and general shape of the used one-piece-tie can only be varied with substantial changes to the tool mechanisms.

SUMMARY

The problem to be solved by the invention at hand can thus be regarded as to provide an improved automatic bundling tool device which can process differently shaped one-piece-ties flexibly and reliably. Advantageous embodiments are apparent from the claims, the description, and the figures.

One aspect relates to an automatic bundling tool device, ABT, for bundling a bundling good by means of a one-piece-tie, OPT, preferably with automatically tightening the OPT by the ABT. In particular, the ABT is configured for bundling a bundling good by means of a cable tie, preferably with automatically tightening the cable tie by the ABT. The ABT may be a non-stationary ABT.

Generally, OPTs, as a generalized concept of a standard cable tie which has a cable tie head part with a window, as well as a cable tie strap part or tail part, which is slid through the window in order to form a loop which can be used to bundle cables or alike, also comprise a neck part, which connects a foot part to the head part, where the foot part comprises some sort of fixing means, for instance as a mushroom head part, that can be used to fix the OPT to an object, for instance a hole in the object. OPTs may belong to one or more given types, where the OPTs belonging to different types differ in foot part geometry (or shape) and/or neck part geometry (or shape) and/or head part geometry (or shape) and/or tail part geometry (or shape), in particular tail part length and/or tail part thickness and/or tail part broadness.

The ABT described here comprises a holding unit configured to receive, hold, and release a respective OPT which is provided to the ABT from an external reservoir of OPTs, preferably from a variable external reservoir device for OPTs that is configured to provide OPTs of different types of OPTs to the ABT, preferably in an order that can be arbitrarily adapted to the application at hand. The ABT further comprises a linear motion guiding unit configured to linearly guide the holding unit in a longitudinal direction while in motion back and forth between a receiving position where the holding unit receives, during intended use, the respective OPT that is processed by the ABT at the time, and a releasing position where the holding unit releases, during intended use, said OPT. The longitudinal direction corresponds to a main extension direction of the OPT, with a tip of the strap part oriented in a forward direction and the head part of the OPT oriented in a backward direction. The linear motion guiding unit enables low friction guiding of the holding unit and allows for high process speeds. Furthermore, the ABT comprises a drive unit configured to move the holding unit along the linear motion guiding unit.

Therein, the holding unit comprises two gripping elements which are arranged movably on a common base element such that they can be moved in a lateral direction running traverse to the longitudinal direction. Here and in the following, "traverse" may refer to "essentially perpendicular", i.e. "perpendicular" or "perpendicular with a given deviation" where the deviation may be, for instance less than 5°, less than 2°, or less than 1°. Each gripping element has a respective gripping contour for accommodating the respective OPT to be received, held, and released during intended use of the ABT. The contour is thus specifically adapted to the respective OPTs to be processed by the ABT. Each gripping element is configured to be moved, in a translational movement in the lateral direction, from an open position for receiving and releasing the respective OPT to a closed position for holding the respective OPT and vice versa. In the open position, a distance between the two gripping elements is larger than in a closed position. Thus, the OPT can be placed in/removed from between the gripping elements. The contours may, at least partly, surround head part and/or neck part and/or foot part of the respective OPT in the closed position to hold the OPT with the holding unit, in particular in a form-fit manner (as described below in more detail). Preferably in both releasing and receiving position of the holding unit, the holding unit may be set into a locked configuration with the gripping elements in the closed position and into an unlocked configuration, where the gripping elements are in the closed position.

So, the problem of processing highly variant OPTs is solved by implementing a new gripping and transport mechanism. Instead of the known flexible pusher acting on the back of a cable tie head or the foot of the OPT, or using a slider with a receiving portion fitted to one single type of OPT, a set of two movable gripping jaws, acting perpendicular to the longitudinal direction is used to firmly hold the OPT head and/or foot part in place, i.e. in a given position relative to the base element. The gripping jaws, implemented in form of gripping elements, are arranged on the base element that is linearly driven forward, i.e. from receiving position to releasing position, in the longitudinal direction to drive the OPT's strap part forward, for example into guiding claws to forming a loop around the bundle.

As each gripping element is movable perpendicular to the longitudinal direction, the gripping elements basically realize an in and out movement. This in and out movement makes it possible to receive even large-size OPT foot parts by opening the gripping jaws, inserting an OPT and then closing the jaws so that they surround or enclose the OPT head part and/or foot part, preferably in a form-fit manner. Furthermore, as the gripping elements are in mechanical contact with the OPT, in particular OPT head part and/or neck part and/or foot part, by closing the gripping jaws, side rotations, that is, small irregularities concerning the orientation of OPTs, especially loose OPTs, are automatically corrected, as the closing gripping elements during their movement into the closed position are capable of automatically rotating and or shifting the respective OPT into the correct position. The firm hold of the gripping elements on the OPTs, in particular head part and/or neck part and/or foot part, ensures that the head and neck and foot part, respectively, do not move during forward motion, thereby reducing the risk of the strap tip diverging sideward from the linear movement. This spares the need of a tight guiding channel around the OPT required in other approaches, which is impossible for most OPTs anyway. Thus more differently shaped types of OPTs can be processed by the ABT, thus flexibility is further increased.

Summarizing, the parallel gripper implemented by the two gripping elements gives the advantage that multiple variants of (even loose) one-piece fixing ties can be held, transported, and released in an automatic bundling tool device. In contrast, formerly, it was only possible to process standard cable ties, both loose and on a bandoleer, without an attached foot part or only one-piece-ties attached to a bandoleer with an automatic bundling tool device. Consequently, the limitation to process only one type of OPT with one type of automatic bundling tool device is removed by the ABT described here, so that multiple types of OPTs can be processed within the same automatic bundling tool without or with only minor modifications to the tool's mechanism. Instead of using a flexible pusher acting on the rear end of a head part of an OPT for the transport process or using a slider using a fixed receiving portion for an OPT, the movable gripping elements allow to hold the OPT in a strictly defined position with a defined gripping force during the complete transport of the OPT in the longitudinal direction within the ABT from receiving position to releasing position. The described approach now also offers the possibility to move a cable tie not only forward, but also backwards, and thus enables further, so far unknown applications. Also a flexible start position for the bundling process can be chosen, for instance when the OPT is provided to the holding unit, which is in the receiving position, then, the holding unit is moved to a starting position, and moved from the starting position to the releasing position in a second step. This is particularly advantageous for OPTs with shorter strap parts, while the ABT would still allow processing of OPTs with longer strap parts as well. Consequently, also the timing of the bundling process can be improved.

In an advantageous embodiment, the gripping contours of the two gripping elements are facing each other, in particular are shaped symmetrically with regard to a middle plane perpendicular to the lateral direction, and are configured to be at least partly form-fit with outer surfaces of at least two given different types of OPTs in the closed position, such that a respective OPT belonging to one of the different types of OPTs may be held in a form-fit arrangement with the gripping elements by the two gripping contours. To this end, the gripping contours may comprise contour sections that, in the closed position, are form-fit with one or more first types of OPTs, but not form-fit with one or more second types of OPTs, and other contour sections that are, in the closed position, form-fit with the second types of OPTs, but not the first types of OPTs. This may apply, mutatis mutandis, also to further types of OPTs, such as third/fourth/ . . . types of OPTs. Different types of OPTs may comprise OPTs differing in head part shape or geometry and/or neck part shape or geometry and/or foot part shape or geometry and/or tail part shape or geometry, in particular tail part length and/or tail part thickness and/or tail part broadness. This gives the advantage that several types of OPTs, in particular several types of foot parts can be accommodated and reliably be held by the gripping elements. Even though head parts of different OPTs usually are not fully standardized, there is a certain degree of commonality between many different types of OPTs that can be exploited. For example, for many types of OPTs there is a gap between the tie head part and the foot part which can be used to slide a wedge-shaped contour part into for holding the OPT in place. For OPT types without such a gap, other contour parts of the gripping elements may provide a form-fit by being adapted to the foot part shape and/or the head part shape. In particular, also similarities between the different head parts, which usually are of a cuboid geometry, and thus comprise at least two parallel outer surfaces, can be exploited.

Correspondingly, the gripping contours may comprise parallel flanks that are configured to mechanically interact with a head part of the respective OPT and/or wedge flanks each with respective set of flanks on each gripping element that are arranged in a pointed angle that are configured to mechanically interact with a neck part of the respective OPT and/or one or more additional flanks adapted to a shape of a foot part of one or more respective given different types of OPTs. This further enhances the reliability of the grip on different OPTs, thus improving flexibility and reliability of the ABT.

The gripping contours may be formed such that, for the given different types of OPTs, the window in the respective head parts of the respective OPTs through which a respective strap part of the OPT is slid to form a loop is always arranged, when the respective OPTs are held by the gripping elements in the closed position, in the same position relative to the base element. This makes sure that the loop of the tie can be properly closed and that the ABT needs not or only minimally be adapted to the different OPT types. Thus, the flexibility and reliability of the ABT is further increased.

In an example embodiment, the holding unit comprises an (actuator) slider element which is mechanically coupled with or attached to the drive unit and movable with respect to the gripping elements and the base element, respectively. The slider element comprises two pin elements that each engage with a respective slit of one of the gripping elements, where the slits extend in a main plane spanned by the longitudinal direction and the lateral direction and are configured to translate a longitudinal movement, that is a movement in the longitudinal direction, of the slider element relative to the gripping elements into a lateral movement, that is a movement in the lateral direction, of the gripping elements with respect to each other. This gives the advantage that the movement of the holding unit in the longitudinal direction can be used to actuate the movement of the gripping elements in the lateral direction. By setting an incitement of the slits relative to longitudinal and lateral direction a conversion of the different movements can be set, for example such that a small force in the linear direction results in a higher force in the lateral direction, that is a higher gripping force. The slider element follows the motion initiated by the drive unit. In particular, the slider element can execute a forward/backward motion relative to the base element. This further enables the flexibility and reliability of the ABT.

Therein, the common base element may be arranged movably in the longitudinal direction on the slider element, with a spring element, which may comprise one or more springs, exerting a spring force on the base element and the slider element that actuates, i.e. pushes or pulls, via the pin elements engaged with the slits, the gripping elements into the closed position. So, for instance, the spring element may push base element and slide element apart from each other in the longitudinal direction with the resulting movement pushing, via the pin elements, the gripping elements together, into the closed position. This gives the advantage that the control of the gripping elements is simplified and automated, thus reliability increased again.

In another example embodiment, at least one spring loaded pivoting pawl element, preferably two spring loaded pivoting pawl elements, is arranged on the common base element with a pivoting axis of the pawl element running traverse the longitudinal direction, where a spring load of the spring loaded pivoting pawl element pushes an end of the pivoting pawl element towards a housing of the ABT such that in the releasing position of the holding unit the end engages with a protrusion of the housing and hinders the common base element from being moved in the longitudinal direction from the releasing position towards the receiving position, that is, in a backward direction. Furthermore, the slider element is configured to engage with the spring loaded pivoting pawl element when the slider element is moved relative to the base element in the backward direction at the releasing position such that the end of the pawl element is pulled back from the protrusion and disengages the protrusion such that the common base element is no longer hindered from being moved in the backward direction towards the receiving position from the releasing position, in particular when the position of the slider element and the base element relative to each other corresponds to the open position of the gripping elements. This configuration has been found particularly advantageous for arriving at a flexible and reliable holding, transporting and releasing of the OPT, which can be controlled only by a sequence of longitudinal movements of the slider element.

In another example embodiment, at least one spring loaded pivoting locking element, preferably two spring loaded pivoting locking elements, is arranged on the common base element with a pivoting axis of the locking element running traverse the longitudinal direction. There, a spring load of the spring loaded pivoting locking element pushes an end of the pivoting locking element towards the slider element such that in the open position of the gripping elements said end of the pivoting locking element engages with a protrusion of the slider element and hinders a relative movement of the slider element and the base element into a position corresponding to the closed position of the gripping elements. Preferably the slider element is moving relative to the base element in the forward direction, opposite to the backward direction, when the gripping elements are in the open position. A further protrusion of the housing of the ABT is configured to engage with the spring loaded pivoting locking element, preferably push the spring loaded pivoting locking element, if slider element and base element are locked in a position corresponding to the open position of the gripping elements by the spring loaded pivoting locking element when the slider element and the base element is, as one locked unit, moved in the backward direction along the linear motion guiding unit such that the end of the locking element is pulled back from the protrusion of the slider element and disengages from the protrusion of the slider element and the base element is no longer hindered from being moved, relative to the slider element, into the position corresponding to the closed position of the gripping elements. This gives the advantage that the gripping elements can be blocked in the open position until they are clear from the foot part/head part of the OPT when rejecting the holding unit from the releasing position back to the receiving position.

In another example embodiment, the drive unit comprises a control unit that is configured to control the drive unit independently of a tool cycle of the ABT, where in particular a speed of the motion of the holding unit in the longitudinal direction along the linear motion guiding unit between receiving position and releasing position and/or an absolute position of the receiving position on the linear motion guiding unit is controlled by the control unit, preferably in dependence upon an OPT type information regarding one or more given different types of OPT provided to the ABT during intended use. This gives the advantage that the holding, transport and release process is made independent from the general tool cycle, so both timing and travel can be set freely for each individual OPT in the process. In particular, this makes it easier to respond to different strap lengths. It also enables a presetting of the mechanism to a certain starting position in the longitudinal direction. For example, for shorter cable ties the gripping elements could rest in a more forward position as compared to longer cable ties, reducing the distance the mechanism has to cover, yielding a shorter cycle time. Here it has to be emphasized that in the known state of the art, the transport of the OPT is rigidly locked to the tool cycle by means of e.g. a crank driven rack/pinion drive. Here, by contrast, the transport process of the OPT in the ABT can also be programmed and electronically controlled by said control unit via e.g. a pulse counting drive or a similar device for position control for exact transport in the longitudinal direction as well as for a precise speed and/or timing control.

In another advantageous embodiment, the drive unit comprises a belt drive to which the holding unit is attached in order to be linearly moved along the linear motion guiding unit. This results in a very reliable and easy-to-control transport of the OPT in the ABT.

Another aspect relates to a system with an ABT of any of the described embodiments, with a flexible OPT reservoir device configured to provide OPTs of different types of OPTs to the ABT, where the OPTs of all types have outer surfaces that form-fit at least partly to contours of the gripping element in the closed position, in particular different contour sections of the gripping elements in the closed position. The OPTs of the different types of OPTs differ at least in one of: a head part shape, a neck part shape, a foot part shape, a strap part length and/or a strap part thickness and/or a strap part broadness.

The flexible OPT reservoir device may also be referred to as a variable reservoir device. The flexible OPT reservoir device may be configured to detachably hold the OPTs, which are single or loose OPTs, on at least one carrier unit of the reservoir device in a row, independently of the ABT. In said row, the OPTs preferably all have the same orientation with respect to the at least one carrier unit associated with the respective OPT. The carrier unit has a base, which may be a cuboid body or have a shape similar to a cuboid. Furthermore, the carrier unit is configured to be moved, e.g. pushed and/or pulled, to or through the ABT in order to have the OPTs detached from the carrier unit by the ABT or a feeding device configured for feeding the OPTs held by the flexible OPT reservoir device to the ABT.

Therein, at least one carrier unit is a unit separate from the OPTs, so it is not materially joined with the respective OPTs. Consequently, the OPTs are loose OPTs and the reservoir device, as well as carrier unit are configured for feeding and holding said loose OPTs. As a consequence, the at least one carrier unit is configured to have the respective OPT, the loose OPT, detachably attached to the carrier unit by a respective interface element of the respective carrier unit which is configured to receive and hold the respective OPT on said carrier unit. In order to attach the respective OPT on said carrier unit, it is moved into/onto the interface element in an insertion direction. Preferably, the at least one carrier unit is configured to hold the OPT by its head part and or its neck part and or its foot part.

In an example embodiment, the flexible OPT reservoir device comprises a multitude of carrier units that are linked or connected to each other via a mechanical connection interface with a predetermined number of degrees of freedom, DOF, for spatial movements of two adjacent carrier units linked to each other, with respect to each other. So, the individual carrier units form a reservoir device similar to a chain, where the individual members of the chain are flexible with respect to each other. Therein, each carrier unit, preferably is configured to hold exactly one OPT. The mechanical connection interface may also comprise a flexible or elastic member which exerts a resetting spring force that acts to move each carrier unit back into a resting or neutral position with respect to the adjacent carrier unit. For instance, this can be realised by one or more elastic bands connecting the adjacent carrier units.

A further aspect relates to a system with an ABT of any of the described embodiments, or the system of the last paragraph, with one or more OPTs of at least one type, preferably two or more different types of OPTs, with outer surfaces that form-fit at least partly the contours of the gripping elements in the closed position.

Therein, advantages and advantageous embodiments of the systems correspond to advantages and advantageous embodiments described for the ABT.

The features and combinations of features described above, including the general part of the description, as well as the features and combinations of features disclosed in the figure description or the figures alone may not only be used alone or in the described combination, but also with other features or without some of the disclosed features without departing the scope of the present disclosure. Consequently, embodiments that are not explicitly shown and described by the figures but that can be generated by separately combining the individual features disclosed in the figures are also part of the present disclosure. Therefore, embodiments and combinations of features that do not comprise all features of an originally formulated independent claim are to be regarded as disclosed. Furthermore, embodiments and combinations of features that differ from or extend beyond the combinations of features described by the dependencies of the claims are to be regarded as disclosed.

BRIEF DESCRIPTION OF THE DRAWINGS

Example embodiments are further described in the following by means of schematic drawings. Therein.

In the different figures, identical or functionally identical features may have the same reference signs.

DETAILED DESCRIPTION

The disclosure relates to an automatic bundling tool device for bundling a bundling good by means of a one-piece-tie, in particular by means of a cable tie. The automatic bundling tool device comprises a holding unit configured to receive, hold, and release a respective one-piece-tie which is provided to the automatic bundling tool device from an external reservoir of one-piece-ties, a linear motion guiding unit configured to linearly guide the holding unit in a longitudinal direction while in motion back and forth between a receiving position where the holding unit receives, during intended use, the respective one-piece tie and a releasing position where the holding unit releases, during intended use, the respective one-piece-tie, as well as a drive unit configured to move the holding unit along the linear motion guiding unit.

Figure 1:
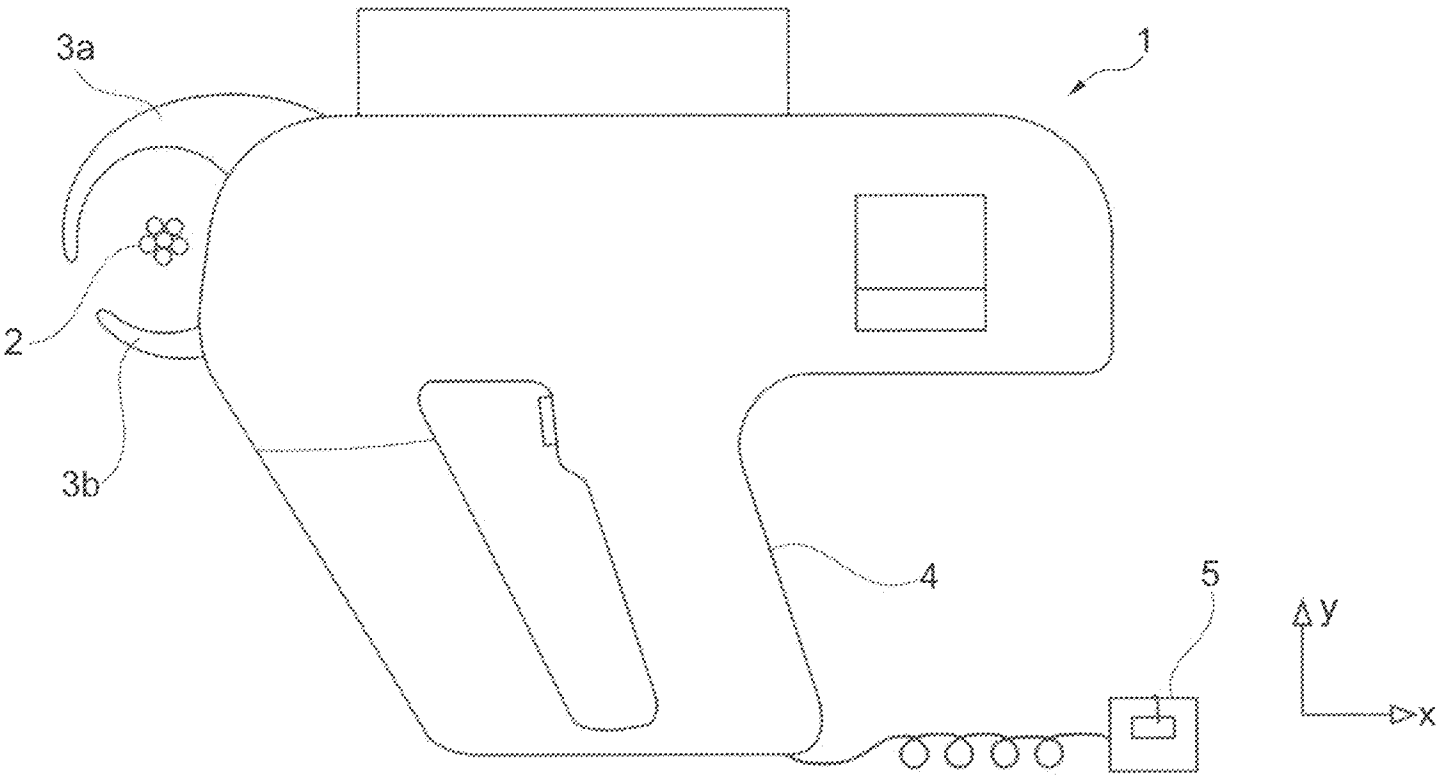
FIG. 1 shows an example embodiment of an automatic bundling tool device, ABT.

FIG. 1 shows an example embodiment of an automatic bundling tool device 1, ABT 1, for bundling a bundling good 2 by means of a one-piece-tie 11 (FIG. 2), OPT 11. Therein, two guiding claws 3*a*, 3*b* are configured to grab around the bundling good 2 and guide said one-piece-tie 11 around the bundling good 2 before it is pulled back into a housing 4 of the ABT 1 in order to form a loop around the bundling good 2. In the present example, the ABT 1 is also connected with a control unit 5 that provides control signals to the ABT 1.

Figure 2:
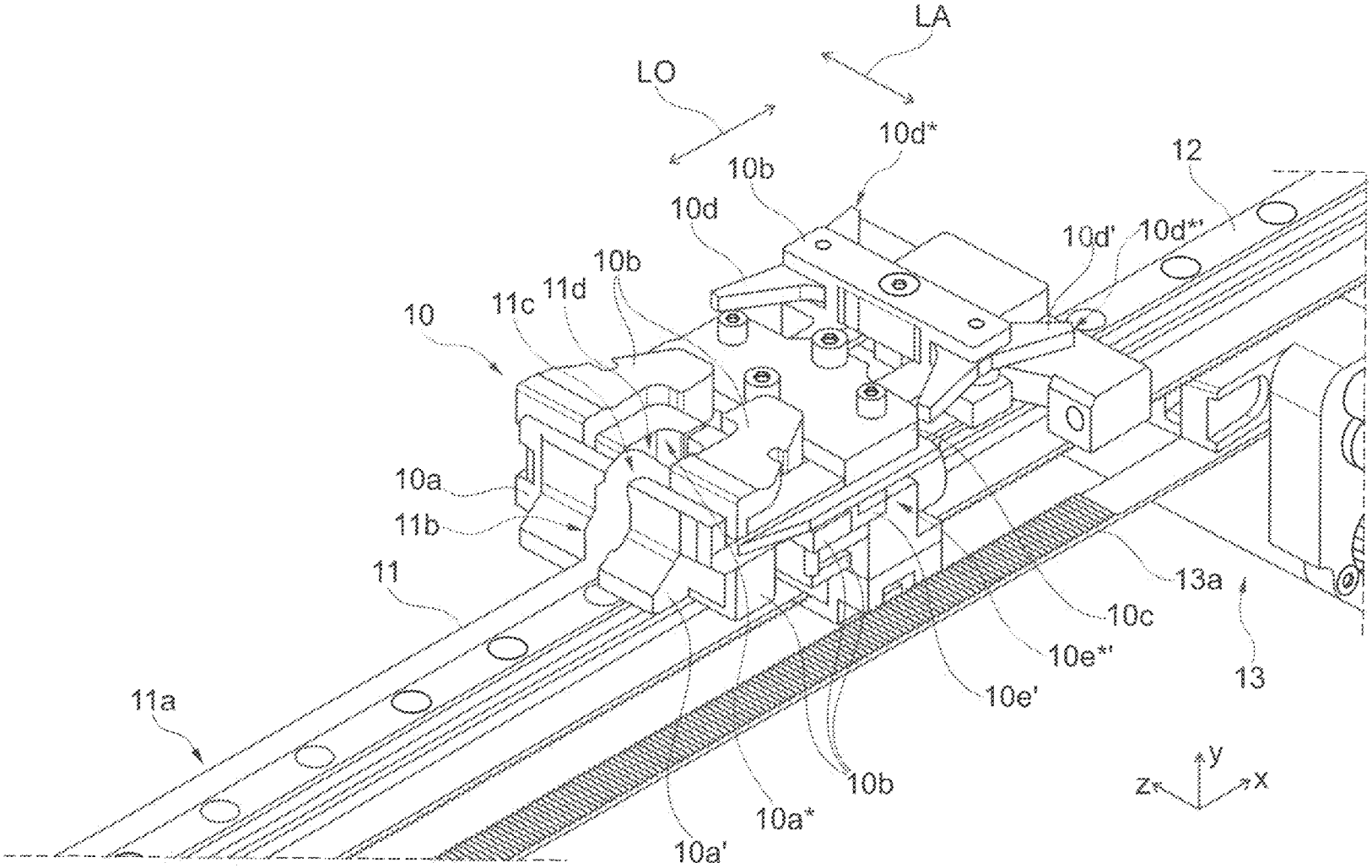
FIG. 2 shows an example embodiment of a holding unit, a linear motion guiding unit and a drive unit.

FIG. 2 shows a perspective view on an example embodiment of a holding unit 10 configured to receive, hold, and release a respective OPT 11 which is provided to the ABT 1 from an external reservoir of OPTs 11, an example embodiment of a linear motion guiding unit 12 configured to linearly guide the holding unit 10 in a longitudinal direction LO, here parallel to the x-axis, while in a motion between a receiving position where the holding unit 10 receives, during intended use, the respective OPT 11, and a releasing position where the holding unit 10 releases, during intended use, the respective OPT 11, and an example embodiment of a drive unit 13 with a belt drive 13*a* to which the holding unit 10 is attached in the present example.

The holding unit 10 comprises two gripping elements 10*a*, 10*a*' which are arranged movably on a common base element 10*b* of the holding unit 10. Each gripping element 10*a*, 10*a*' is provided with a respective gripping contour 10*a, 10*a' for accommodating the respective OPT 11, in particular a head part 11*b* and/or a neck part 11*c* and/or a foot part 11*d* of the OPT 11. Each gripping element 10*a*, 10*a*' is configured to each be moved, in a translational movement, that is, a straight movement, in a lateral direction LA perpendicular to the longitudinal direction LO here, from an open position of the gripping elements 10*a*, 10*a*' for receiving and releasing the respective OPT 11 to a closed position of the gripping elements 10*a*, 10*a*' for holding the respective OPT 11 and vice versa. In the shown example, the lateral direction LA is parallel to the z-axis.

In the present example, the holding unit 10 comprises a slider unit 10*c* which is mechanically coupled to the drive unit 13 and movable with respect to the base element 10*b* and the gripping elements 10*a*, 10*a*'. The slider element 10*c* comprises two pin elements 10*f*, 10*f* (FIG. 7) that each engage with a respective slit 10*a*#, 10*a*#' of one of the gripping elements 10*a*, 10*a*', where the slits 10*a*#, 10*a*#' extend in a main plane spanned by the longitudinal direction LO and the lateral direction LA, i.e. in the x-z-plane. The slits 10*a*#, 10*a*#' are configured to translate a longitudinal movement of the slider element 10*c* relative to the gripping elements 10*a*, 10*a*' into a lateral movement of the gripping elements 10*a*, 10*a*' with respect to each other.

In the present example the base element 10*b*, which may comprise several sub-elements, holds the gripping elements 10*a*, 10*a*' and comprises elongate protrusions orientated perpendicular to the longitudinal axis LO, which act as guides and offer the gripping elements 10*a*, 10*a*', in the present example, exactly one degree of freedom in their movement relative to the base element 10*b*. The base element 10*b* comprises a sub-element sitting on the linear motion guide unit 12, and has itself, in the present only one degree of freedom in its movement relative to the linear motion guide unit 12. It is thus able to move forwards and backwards in the longitudinal direction LO.

Correspondingly, the gripping elements 10*a*, 10*a*', in the present example, contain grooves engaging with said protrusion of the base element 10*b* and, by this, are restricted to said one degree of freedom in their movement relative to the base element 10*b*. This means the gripping elements 10*a*, 10*a*' can follow an in and out motion perpendicular to the longitudinal axis LO, basically acting as a parallel gripper. By pushing the gripping elements 10*a*, 10*a*' of the parallel gripper firmly together, they act on outer surfaces of the OPT 11 and enclose parts such as head part 11*b* and/or foot part 11*c* in a form-fit connection. Thus, the OPT 11 can be held in place reliably by a corresponding gripping force.

The slider element 10*c* is attached to the drive unit 13, in particular the belt 13*a* in the present example, by a corresponding connecting element. It therefore follows any motion performed by the drive unit 13, that is, the belt 13*a* along the longitudinal direction LO. Furthermore, the slider element 10*c* can execute a forward backward motion relative to the base element 10*b* in the longitudinal direction LO, as the base element 10*b* is not fixed onto the belt 13*a* here.

In the present example, the holding unit 10 comprises also a spring element 10*g*, 10*g*' (FIG. 7) exerting a spring force on base element 10*b* and slider element 10*c* that actuates, by pushing slider element 10*c* relative to base element 10*b*, via the pin elements 10*f*, 10*f* engaged with the slits 10*a*#, 10*a*#', the gripping elements 10*a*, 10*a*' into the closed position. In the present example, the spring element 10*g*, 10*g*', by acting upon the slider element 10*c*, pushes the slider element 10*c* forward, that is, in a negative x-direction parallel to the longitudinal direction LO to the base element 10*b* and thereby pushes the gripping elements 10*a*, 10*a*' together. Therefore, in a resting position without any additional external force, the slider element 10*c* keeps up the gripping force and secures the OPT 11 in place between the gripping elements 10*a*, 10*a*'. During operation of the drive unit 13, due to the spring load, the base element 10*b* will follow the slider element's motion without relative motion between slider element 10*c* and base element 10*b*. Thus, the OPT 11 can be conveyed safely from the receiving position to the releasing position. By moving the slider element 10*c* backwards, that is, in positive x-direction, with respect to the base element 10*b*, the gripping elements 10*a*, 10*a*' will be moved, in this example, in an open position.

Namely, during a tool cycle, the OPT 11 has to be inserted and, after bundling, released from the gripping elements 10*a*, 10*a*'. This requires the gripping elements 10*a*, 10*a*' to be opened. As described above, any backwards motion of the slider element 10*c* relative to the base element 10*b* will open the gripping elements 10*a*, 10*a*' in the shown example. However, due to the spring load, in the present example the base element 10*b* follows the slider element's movement, inhibiting relative motion. Hence, in order to allow for relative motion between base element 10*b* and slider element 10*c*, the base element 10*b* has to be kept in a fixed position, leaving only the slider element 10*c* to be able to move along the longitudinal direction LO. For this, spring loaded pivoting pawl elements 10*d*, 10*d*' are arranged, in the present example, on the base element 10*b* with a pivoting axis of the pawl elements 10*d*, 10*d*' running traverse the longitudinal direction LO, here running in the y-direction. Consequently, the pawl elements 10*d*, 10*d*' are able to rotate in the horizontal x-z-plane in the present example. The pawl elements 10*d*, 10*d*' are spring loaded such that their rear ends 10*d, 10*d' are pushed outwardly to the housing 4 of the ABT 1 such that in the releasing position of the holding unit 10, the end 10*d, 10*d' engages with a corresponding protrusion of the housing 4 and hinders the common base element 10*b* from being moved backwards in the longitudinal direction LO, that is in positive x-direction towards the receiving position. This is described in more detail below with reference to FIGS. 7 and 8.

After releasing the OPT 11 in the maximum forward position, the releasing position, the slider element 10*c* and the base element 10*b* have to move further backwards until the whole holding unit 10 reaches its initial position, the receiving position. As the bundle with bundling good 2 and OPT 11 with its foot part 11*d* may still be in place in the ABT 1 at this time, the gripping elements 10*a*, 10*a*' have to remain in the open position until they clear the foot part 11*d* in order to avoid pull on the bundling good 2. To this end, at least one, in the present example two spring loaded pivoting locking elements 10*e*, 10*e*' are arranged on the base element 10*b* with a pivoting axis of the locking elements 10*e*, 10*e*' running traverse the longitudinal direction LO, along the y-direction in the present example. In the present example these locking elements 10*e*, 10*e*' rotate inwards and slide into grooves of the slider element 10*c* thus engaging with protrusions 10*c*#, 10*c*#' of the slider element 10*c*, as soon as the slider element 10*c* has covered a certain distance during backward/release motion. With the locking elements 10*e*, 10*e*' resting against the protrusion of the slider element 10*c*, it is jammed and cannot move forwards relative to the base element 10*b*, keeping the gripping elements 10*a*, 10*a*' open.

So, the spring load of the locking element 10*e*, 10*e*' pushes an end 10*e, 10*e' of the locking element 10*e*, 10*e*' towards the slider element 10*c* such that in the open position of the gripping elements 10*a*, 10*a*' the end 10*e, 10*e' engages with the protrusion of the slider element 10*c* and hinders a relative movement of the slider element 10*c* and base element 10*b* into a position corresponding to the closed position of the gripping elements 10*a*, 10*a*'. This is explained in more detail below with reference to FIGS. 9 and 10.

Consequently, an example complete holding, transport, and release process consists of several steps as follows:

Loading

The cable tie 11 has to be inserted into the gripping elements 10*a*, 10*a*'. For this the drive unit 13 will pull the slider element 10*c* backwards from its resting position. Consequently, due to the spring element 10*g*, 10*g*' exerting the spring force on base element 10*b* and slider element 10*c*, the base element 10*b* is pushed backwards in the x-direction against a stopper, which prevents it from moving further backwards. Thus, the gripping elements 10*a*, 10*a*' open and the OPT 11 can be transferred from the external reservoir device to the ABT 1. When the OPT 11 is positioned between the gripping elements 10*a*, 10*a*', the gripping elements 10*a*, 10*a*' have to be closed in order to secure the OPT 11. To do so, the drive unit 13 reverses its direction and moves the slider element 10*c* forwards, in a negative x-direction, back to its initial position. Due to the spring force of the spring elements 10*g*, 10*g*', slider element 10*c* and base element 10*b* are moved back in a relative position that corresponds to the closed position of the gripping elements 10*a*, 10*a*'.

Moving Forward

The OPT 11 has to be moved forward in the negative x-direction into guides such as the guide claws 3*a*, 3*b* around the bundle good 2. To do so, the drive unit 13 moves the slider element 10*c* forwards, carrying the base element 10*b* along without relative motion between base element 10*b* and slider element 10*c*, so that the gripping elements 10*a*, 10*a*' remain closed and hold the OPT 11.

Reaching Releasing Position

When the gripping elements 10*a*, 10*a*' reach their maximum forward position, the releasing position, the tip of the strap part 11*a* of the OPT 11 will be threaded through a window of the OPT 11 and the strap will be tensioned. During tensioning, the OPT 11 has to be kept in place. Therefore, the holding unit 10 stays in the release position without any motion.

Releasing

After tensioning is completed, the OPT 11 has to be released from the gripping elements 10*a*, 10*a*' for the bundle to be freed. In order to do so, the drive unit 13 moves the slider element backwards to open the gripping elements 10*a*, 10*a*'. Due to the spring load, the base element 10*b* will follow the backward motion. After a minimal travel, the pawl elements 10*d*, 10*d*' jam against the housing 4 and prevent further backward motion of the base element 10*b*, while the slider element 10*c* is driven further backwards relative to the base element 10*b* by the drive unit 13, as explained in more detail referring to FIGS. 7 and 8. With the slider element 10*c* moving backwards relative to the base element 10*b*, the locking elements 10*e*, 10*e*' will rotate inwards, thereby blocking the slider element 10*c* in a position corresponding to the open position of the gripping elements 10*a*, 10*a*'. Doing so, the actuator slider element 10*c* cannot move forwards relative to the base element 10*b* so that the clamping jaws, the gripping elements 10*a*, 10*a*' stay in the open position.

Moving Backwards/Closing the Gripping Elements

Figure 8:
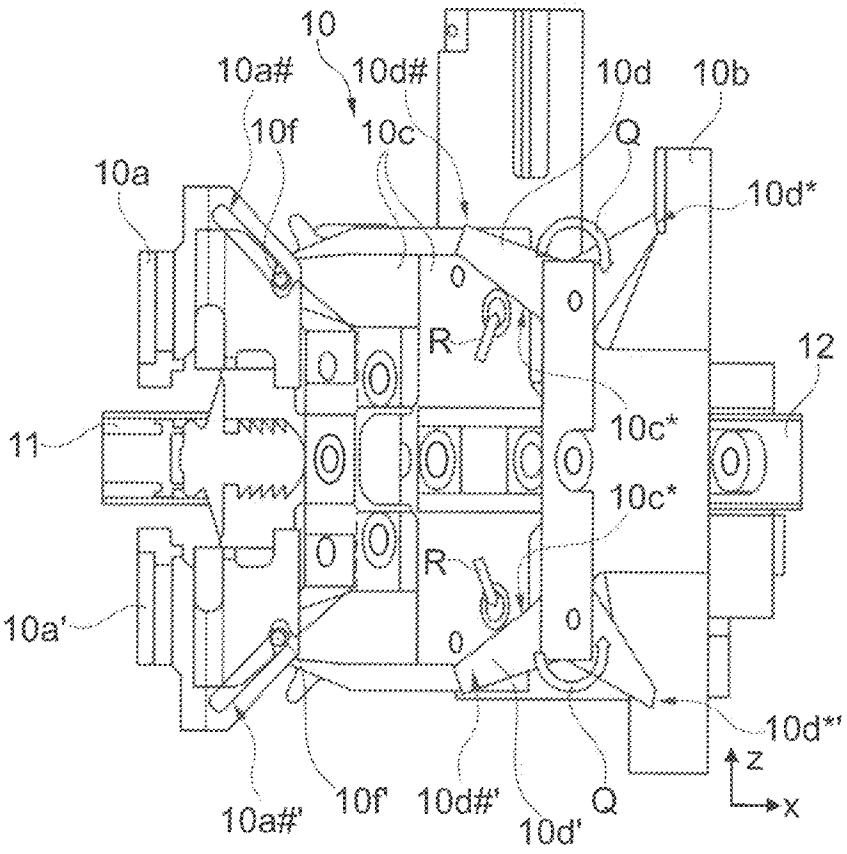
FIG. 8 shows the holding unit of FIG. 7 with the gripping elements in an open position.

Further backward motion of the slider element 10*c* pushes it against the pawl elements 10*d*, 10*d*' and rotates said pawl elements 10*d*, 10*d*' so that they clear the protrusion of the housing 4 and unblock the base element 10*b* from backward motion, as shown in FIG. 8. Now, the holding unit 10 can freely move backwards to its initial position. After a certain backwards travel, the locking elements 10*e*, 10*e*' get in contact with a further protrusion of the housing 4. Doing so the locking elements 10e' are rotated, in the present example, outwards so that they free the blocked slider element 10c, allowing it to move forward again with respect to the base element 10b and thus, due to the spring force of the spring elements 10g, 10g', close the gripping elements 10a, 10a'.

Figure 3:
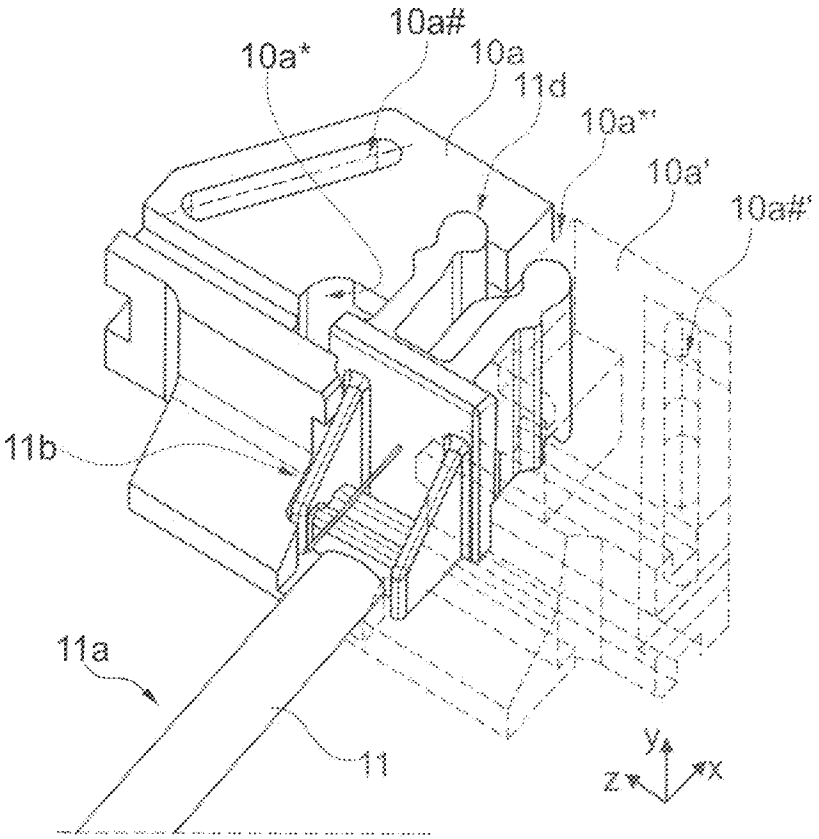
FIG. 3 shows an example embodiment of two gripping elements with a first example type of one-piece-tie.

FIG. 3 shows an example embodiment of two gripping elements 10a, 10a' with respective gripping contours 10a*, 10a*' that are configured to be at least partly form-fit with outer surfaces of at least two given different types of OPTs 11 in the closed position. In the present example, said outer surfaces are surfaces of the foot part 11d and the head part 11b of the OPT 11. In the shown example, the gripping contours 10a*, 10a*' are symmetric with regard to the middle plane perpendicular to the lateral direction. Also, in the plane of lateral and longitudinal direction, the x-z-plane, each of the gripping elements 10a, 10a' features slit 10a#, 10a#' that is inclined relative to both longitudinal direction LO and lateral direction LA to translate a longitudinal movement of the slider element 10c relative to the base element 10b into a lateral movement of the gripping elements 10a, 10a' with respect to each other via the guidance provided by the pin elements 10f, 10f of the slider element 10c and the above-mentioned elongate protrusions of base element 10b.

Figure 4:
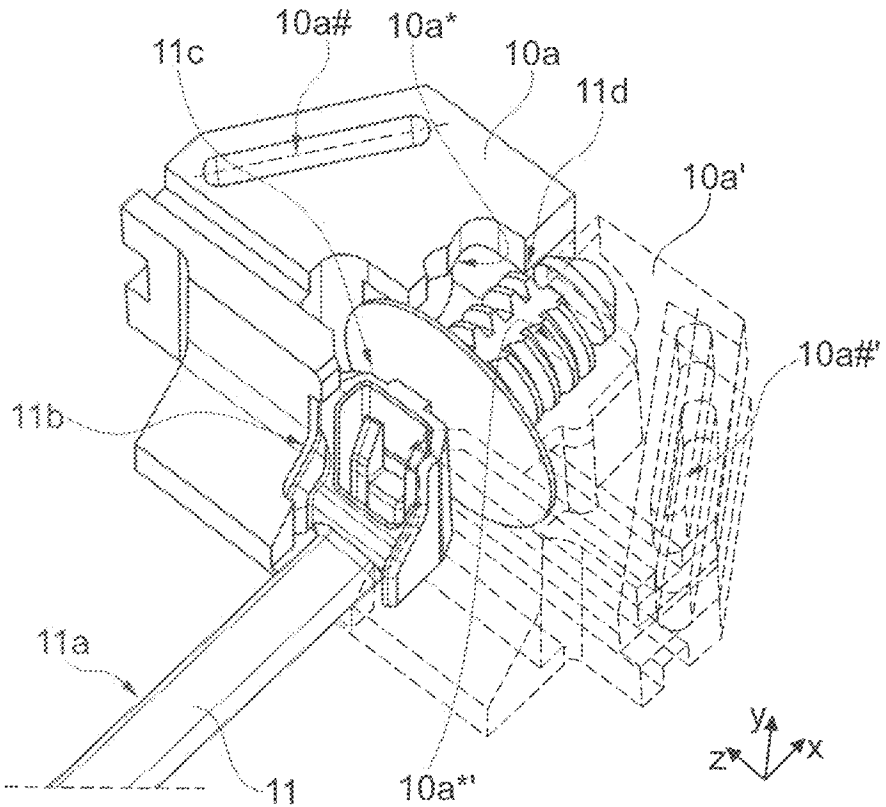
FIG. 4 shows the gripping elements of FIG. 3 with a second example type of one-piece-tie.

FIG. 4 shows the gripping elements 10a, 10a' of FIG. 3 with an OPT 11 of a different type. Thus, the example gripping elements 10a, 10a' can be used to hold OPTs 11 of different OPT types firmly in the desired position. The positions of the gripping elements 10a, 10a' relative to each other in the closed position may differ from OPT type to OPT type.

Figure 5:
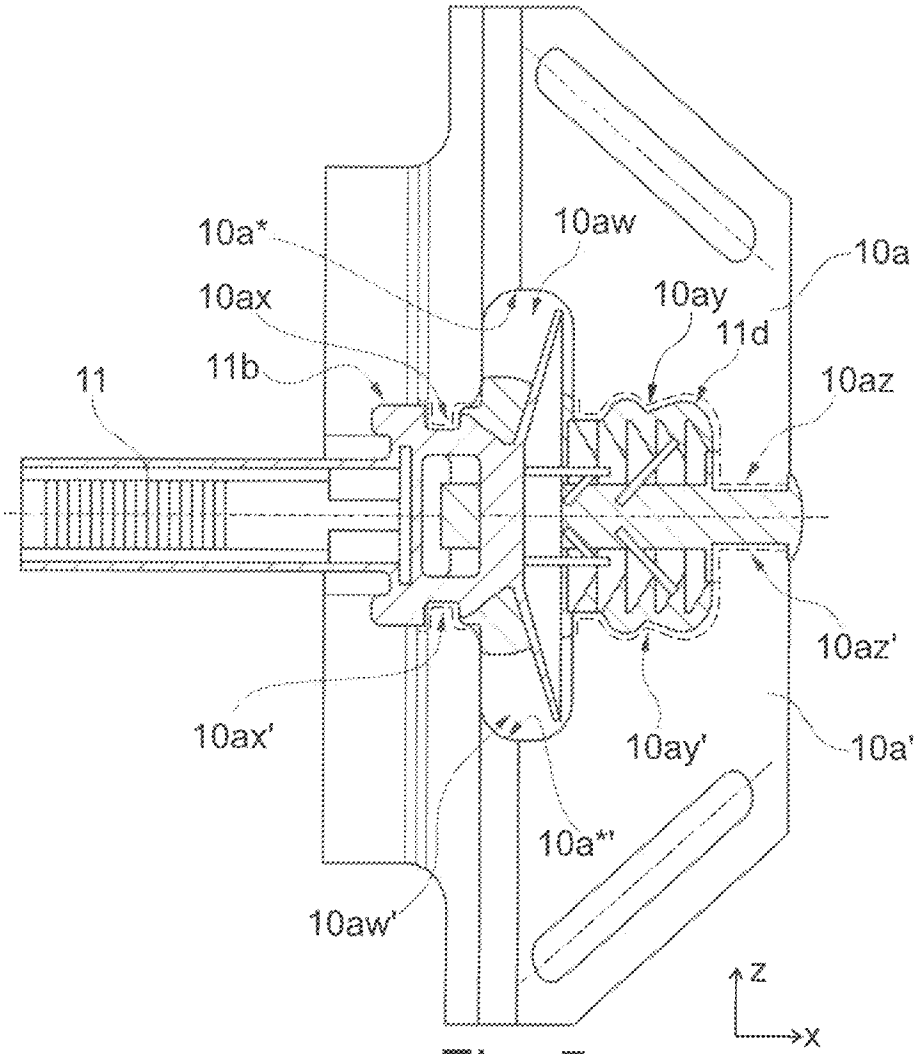
FIG. 5 shows the example gripping elements of FIGS. 3 to 5 in a closed position.

FIG. 5 shows in more detail how such an increased flexibility is possible. Namely the contours 10a*, 10a*' comprise respective different contour sections, first contour sections 10ax, 10ax', second contour sections 10ay, 10ay', and third contour sections, 10az, 10az' in the present example. The first contour sections 10ax, 10ax', in the present example, are designed to provide a form-fit hold on the head part 11b of the two different types of OPTs. This is possible as, in the present example, the head part 11b of the two different OPTs shown in FIGS. 3 and 4 are of identical or very similar shape. The second contour sections 10ay, 10ay' are used to provide a form-fit grip on the foot part 11d of the OPT 11 of FIG. 3, i.e. the OPT type of FIG. 3. When the OPT 11 of FIG. 4 is held by the gripping elements 10a, 10a', the second contour sections 10ay, 10ay' do not have any particular function except for providing space for the OPT 11 of FIG. 4. The third contour sections 10az, 10az', vice versa, are configured to provide a form-fit grip on the OPT 11 of FIG. 4, i.e. the OPT type of FIG. 4, in the closed position of the gripping elements 10a, 10a', but do not have a function when the OPT 11 of FIG. 3 is held by the gripping elements 10a, 10a'. Furthermore, in the present example, the gripping elements 10a, 10a' of the present example provide respective recesses 10aw, 10aw' that just give space and enable the holding of very large OPTs 11.

Figure 6:
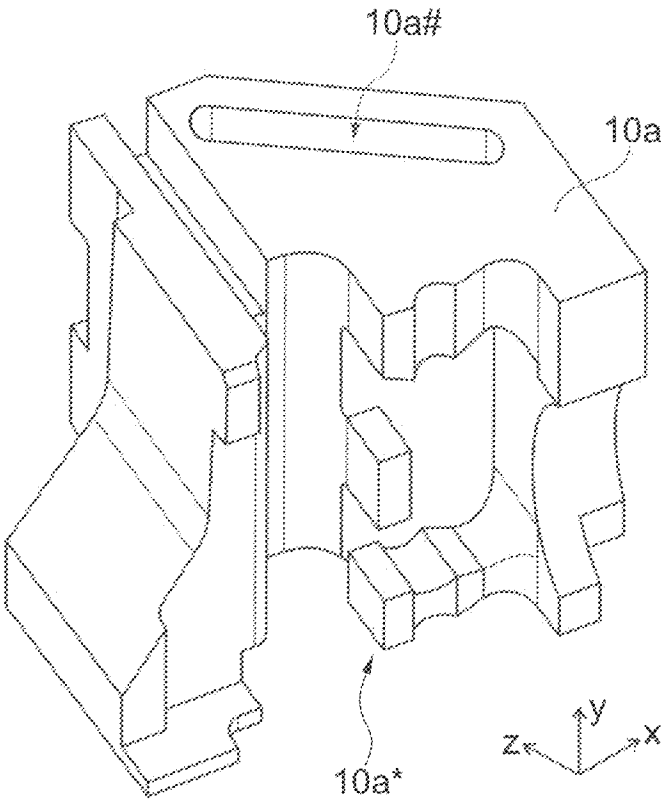
FIG. 6 shows a single one of the gripping elements of FIGS. 3 and 4.

FIG. 6 gives a more detailed view on a gripping element 10a with a specific example contour 10a*, which is used in the present example to enable a form-fit mechanical connection between gripping contours 10a*, 10a*' of the two gripping elements 10a, 10a' of FIG. 5. Note that, in the present example, the gripping contours 10a*, 10a*' are symmetric with regard to a middle plane perpendicular to the lateral direction, that is, with regard to a x-y plane.

Figure 7:
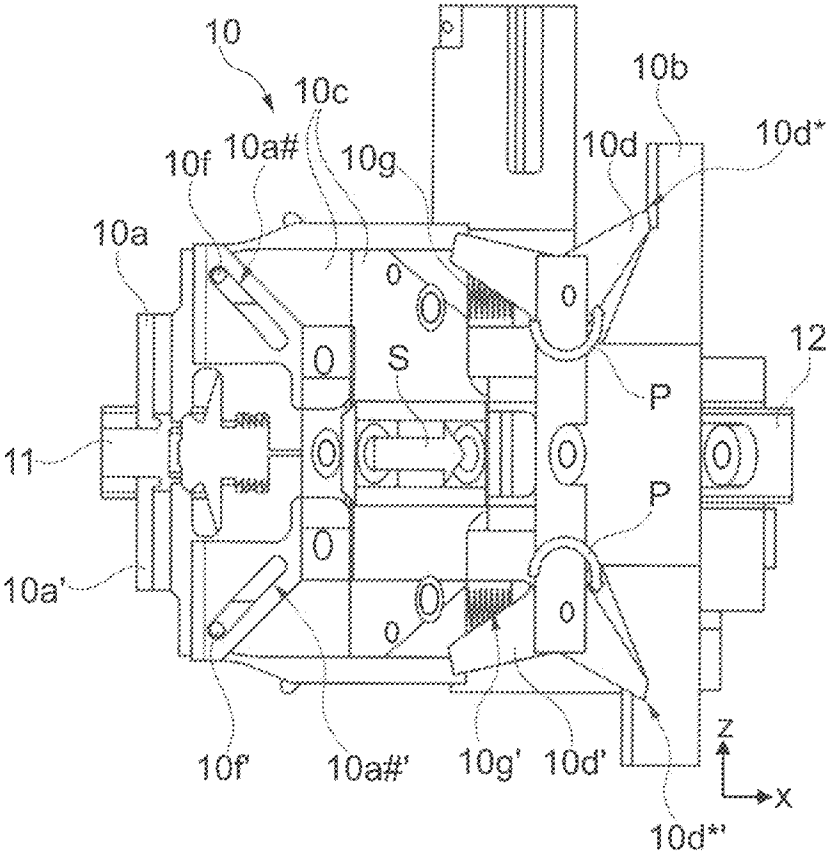
FIG. 7 shows an example embodiment of a holding unit with gripping elements in a closed position.

FIGS. 7 and 8 show an example embodiment of a holding unit 10 with the gripping elements 10a, 10a' in a closed and open position, respectively.

In FIG. 7, the ends 10d*, 10d*' of the respective pawl elements 10d, 10d' are pushed, by a spring load indicated by the arrows P, towards a housing of the ABT 1, in the present example outwardly, protrusions of the housing 4 arranged such that in the releasing position of the holding unit 10, the ends 10d*, 10d*' engage with said protrusion of the housing 4 and hinder the base element 10b from being moved backwards in the longitudinal direction LO towards the receiving position, that is, in positive x-direction.

Thus, when the slider element 10c is moved backwards as indicated by the arrow S, the base element 10b cannot follow this movement, with the resulting relative movement of slider element 10c with respect to base element 10b moving the gripping elements 10a, 10a' in an open position via the pin elements 10f, 10f'. This is due to the pawl elements 10d, 10d' compensating the force exerted on the base element 10b through the backwards motion of the slider element 10c via the spring elements 10g, 10g'.

As the base element 10b needs to be moved backwards to the receiving position at some point, the holding unit 10 of the present example is configured to disengage the ends 10d*, 10d*' of the pawl elements 10d, 10d' as shown in FIG. 8. Namely, the backward end section 10c* of the slider element 10c is configured to interact, at some point when being moved backwards in the longitudinal direction, with the pawl elements 10d, 10d*, in particular with front ends 10d#, 10d#' of said pawl elements 10d, 10d* such that they are pushed, as indicated by the arrows R, outwardly, resulting in a rotation of the pawl elements 10d, 10d' as indicated by the arrows Q, that moves the ends 10d*, 10d*' inwardly. Thus, the ends 10d*, 10d*' disengage the protrusion of the housing 4. Consequently, the holding unit 10 may move in the positive x-direction backwards to the receiving position actuated by the slider element 10c.

Figure 10:
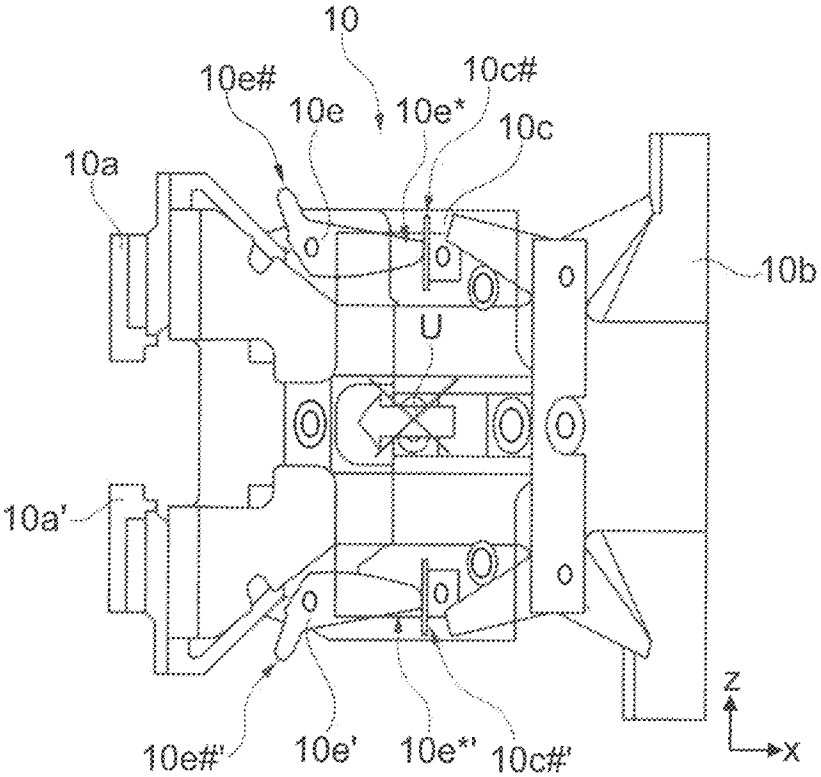
FIG. 10 shows the example embodiment of FIG. 9 with the gripping elements in the open position.
Figure 9:
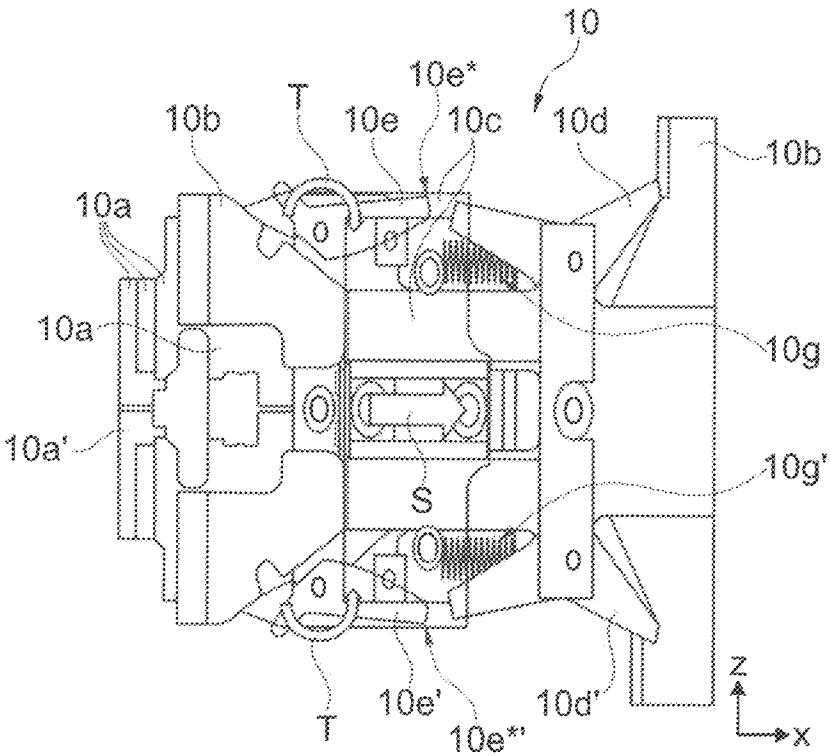
FIG. 9 shows another example embodiment of a holding unit with the gripping elements in the closed position.

FIGS. 9 and 10 show example embodiments of the holding unit 10 where, starting from a situation similar to that shown in FIG. 8, the gripping elements 10a, 10a' remain in the open position while the slider element 10c and the base element 10b can be moved freely along the linear motion guiding unit in spite of the spring force of the spring elements 10g, 10g'. In particular, the holding unit 10 of FIG. 9 comprises at least one, in the shown example two spring loaded pivoting locking elements 10e, 10e' which are arranged on the base element 10b with a pivoting axis of the locking elements 10e, 10e' running traverse the longitudinal direction LO. Therein, a spring load of the locking element 10e, 10e' actuates respective ends 10e*, 10e*' of the locking elements 10e, 10e' towards the slider element 10c, that is, inwards in the present example. The motion initiated by said spring load is indicated by the arrows T here. Consequently, similar to FIG. 7, the slider element 10c can be moved in the positive x-direction relative to the base element 10b if said base element 10b is for instance held, as described with reference to FIG. 7, in a fixed position relative to the housing.

Thus, as described above, the gripping elements 10a, 10a' can be moved in the open position, which is also shown in FIG. 10. Here it is shown that in a relative position of slider element 10c and base element 10b with respect to each other that correspond to the open position of the gripping elements 10a, 10a', the ends 10e*, 10e*' interact with respective protrusions 10c#, 10c#' of the slider element 10c and hinder a relative movement of slider element 10c and base element 10b into a position corresponding to the closed position of the gripping elements 10a, 10a', as indicated by the crossed-out arrow U.

Consequently, the complete holding unit can be, in the shown configuration, moved back and forth in the longitudinal direction LO while keeping the gripping elements 10*a*, 10*a*' in the shown open position.

In order to allow the holding unit 10 to change its configuration back into a closed configuration of the gripping elements 10*a*, 10*a*', a further protrusion of the housing 4 of the ABT is configured to engage with ends 10*e*#, 10*e*#' of the locking elements 10*e*, 10*e*' when the base element 10*b* is moved in the backward direction along the linear motion guiding unit 12 such that the first end 10*e, 10*e' of the locking element disengages from the protrusions 10*c*#, 10*c*#' of the slider element 10*c*. Then, the base element 10*b* is no longer hindered from being moved, relative to the slider element 10*c*, into the position corresponding to the closed position of the gripping elements 10*a*, 10*a*' as a consequence of the spring force of the spring elements 10*g*, 10*g*'.

The use of "example," "advantageous," and grammatically related terms means "serving as an example, instance, or illustration," and not "preferred" or "advantageous over other examples." Items represented in the accompanying figures and terms discussed herein may be indicative of one or more items or terms, and thus reference may be made interchangeably to single or plural forms of the items and terms in this written description. The use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"), unless the context clearly dictates otherwise. Also, as used herein, a phrase referring to "at least one of" a list of items refers to any combination of those items, including single members. For instance, "at least one of a, b, or c" can cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, c-c-c, or any other ordering of a, b, and c).

What is claimed is:

1. An automatic bundling tool device (ABT) configured for bundling a bundling good by means of a one-piece-tie (OPT), the ABT comprising:

a holding unit configured to receive, hold, and release a respective OPT which is provided to the ABT from an external reservoir of OPTs;

a linear motion guiding unit configured to linearly guide the holding unit in a longitudinal direction while moving between a receiving position where the holding unit receives, during intended use, the respective OPT and a releasing position where the holding unit releases, during intended use, the respective OPT; and a drive unit configured to move the holding unit along the linear motion guiding unit, wherein the holding unit comprises two gripping elements which are arranged movably on a common base element, each gripping element with a respective gripping contour for accommodating the respective OPT, and configured to each be moved, in a translational movement in a lateral direction running traverse to the longitudinal direction, from an open position for receiving and releasing the respective OPT to a closed position for holding the respective OPT and from the closed position to the open position.

2. The ABT of claim 1, wherein the gripping contours of the two gripping elements face each other.

3. The ABT of claim 2, wherein the gripping contours of the two gripping elements are symmetric with regards to a middle plane perpendicular to the lateral direction, and are configured to be at least partly form fit with outer surfaces of at least two given different types of OPTs in the closed position.

4. The ABT of the claim 3, wherein the gripping contours are formed such that, for the given different types of OPTs, a window in respective head parts of the respective OPTs is always arranged, when the respective OPTs are held by the gripping elements in the closed position, in the same position relative to the base element.

5. The ABT of claim 2, wherein the gripping contours comprise at least one of:

parallel flanks that are configured to mechanically interact with a head part of the respective OPT;

wedge flanks that are configured to mechanically interact with a neck part of the respective OPT; or one or more additional flanks adapted to a shape of a foot part of one or more respective given different types of OPTs.

6. The ABT of claim 1, wherein the gripping contours comprise at least one of:

parallel flanks that are configured to mechanically interact with a head part of the respective OPT;

wedge flanks that are configured to mechanically interact with a neck part of the respective OPT; or one or more additional flanks adapted to a shape of a foot part of one or more respective given different types of OPTs.

7. The ABT of claim 1, wherein the holding unit comprises a slider element, the slider element mechanically coupled to the drive unit and movable with respect to the gripping elements and the base element, and the slider element comprising two pin elements that each engage with a respective slit of one of the gripping elements, where the slits extend in a main plane spanned by the longitudinal direction and the lateral direction and are configured to translate a longitudinal movement of the slider element relative to the gripping elements into a lateral movement of the gripping elements with respect to each other.

8. The ABT of claim 7, wherein at least one spring loaded pivoting pawl element is arranged on the base element with a pivoting axis of the pawl element running traverse the longitudinal direction, where a spring load of the pawl element pushes an end of the pawl element towards a housing of the ABT such that in the releasing position of the holding unit the end engages with a protrusion of the housing and hinders the base element from being moved in the longitudinal direction from the releasing position towards the receiving position, in a backward direction, and the slider element is configured to engage with the pawl element when the slider element is moved relative to the base element in the backward direction at the releasing position such that the end of the pawl element disengages from the protrusion and the base element is no longer hindered from being moved in the backward direction.

9. The ABT of claim 7, wherein the common base element is arranged movably on the slider element, with a spring element exerting a spring force on base element and slider element that actuates, via the pin elements engaged with the slits, the gripping elements into the closed position.

10. The ABT of claim 9, wherein:

at least one spring loaded pivoting pawl element is arranged on the base element with a pivoting axis of the pawl element running traverse the longitudinal direction, where:

a spring load of the pawl element pushes an end of the pawl element towards a housing of the ABT such that in the releasing position of the holding unit the end engages with a protrusion of the housing and hinders the base element from being moved in the longitudinal direction from the releasing position towards the receiving position, in a backward direction, and the slider element is configured to engage with the pawl element when the slider element is moved relative to the base element in the backward direction at the releasing position such that the end of the pawl element disengages from the protrusion and the base element is no longer hindered from being moved in the backward direction.

11. The ABT of claim 10, wherein the at least one spring loaded pivoting pawl element comprises two spring loaded pivoting pawl elements.

12. The ABT of claim 10, wherein at least one spring loaded pivoting locking element is arranged on the base element with a pivoting axis of the locking element running traverse the longitudinal direction, where a spring load of the locking element pushes an end of the locking element towards the slider element such that in the open position of the gripping elements the end engages with a protrusion of the slider element and hinders a relative movement of slider element and base element into a position corresponding to the closed position of the gripping elements.

13. The ABT of claim 12, wherein a further protrusion of the housing of the ABT is configured to engage with the locking element if the slider element and the base element are locked in a position corresponding to the open position of the gripping elements by the locking element when the base element is moved in the backward direction along the linear motion guiding unit such that the end of the locking element disengages from the protrusion of the slider element and the base element is no longer hindered from being moved, relative to the slider element, into the position corresponding to the closed position of the gripping elements.

14. The ABT of claim 13, wherein the drive unit comprises:

a control unit configured to control the drive unit independently of a tool cycle of the ABT by at least one of:

controlling a speed of the motion of the holding unit in the longitudinal direction along the linear motion guiding unit between receiving position and releasing position; or controlling an absolute position of the receiving position on the linear motion guiding unit.

15. The ABT of claim 14, wherein the control unit is configured to control in dependence upon an OPT type information regarding one or more given different types of OPTs provided to the ABT during intended use.

16. The ABT of claim 1, wherein the drive unit comprises a belt drive to which the holding unit is attached.

17. A system comprising:

a holding unit configured to receive, hold, and release a respective one-piece-tie (OPT) provided from an external flexible OPT reservoir, the holding unit comprising:

two gripping elements which are arranged movably on a common base element, each gripping element with a respective gripping contour for accommodating the respective OPT, and configured to each be moved, in a translational movement in a lateral direction running traverse to a longitudinal direction, from an open position for receiving and releasing the respective OPT to a closed position for holding the respective OPT and from the closed position to the open position;

a linear motion guiding unit configured to linearly guide the holding unit in the longitudinal direction while moving between a receiving position where the holding unit receives, during intended use, the respective OPT and a releasing position where the holding unit releases, during intended use, the respective OPT;

a drive unit configured to move the holding unit along the linear motion guiding unit; and the flexible OPT reservoir configured to provide OPTs of different types of OPTs, where OPTs of all types have outer surfaces that form-fit at least partly the contours of the gripping elements in the closed position.

18. The system of claim 17, wherein the OPTs of the different types differ at least in one of:

a head part shape;

a neck part shape;

a foot part shape;

a strap part length;

a strap part thickness; or a strap part broadness.

19. The system of claim 17, further comprising:

one or more OPTs of at least one type with outer surfaces that form-fit at least partly the contours of the gripping elements in the closed position.

20. A system comprising:

a holding unit configured to receive, hold, and release a respective one-piece-tie (OPT) provided from an external reservoir of OPTs, the holding unit comprising:

two gripping elements which are arranged movably on a common base element, each gripping element with a respective gripping contour for accommodating the respective OPT, and configured to each be moved, in a translational movement in a lateral direction running traverse to a longitudinal direction, from an open position for receiving and releasing the respective OPT to a closed position for holding the respective OPT and from the closed position to the open position;

a linear motion guiding unit configured to linearly guide the holding unit in the longitudinal direction while moving between a receiving position where the holding unit receives, during intended use, the respective OPT and a releasing position where the holding unit releases, during intended use, the respective OPT;

a drive unit configured to move the holding unit along the linear motion guiding unit; and one or more OPTs of at least one type with outer surfaces that form-fit at least partly the contours of the gripping elements in the closed position.

* * * * *